US007625044B2

(12) United States Patent
Piretti

(10) Patent No.: US 7,625,044 B2
(45) Date of Patent: Dec. 1, 2009

(54) CHAIR BACKREST WITH INTEGRAL LUMBAR SUPPORT

(75) Inventor: Giancarlo Piretti, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 122 days.

(21) Appl. No.: 11/856,519

(22) Filed: Sep. 17, 2007

(65) Prior Publication Data

US 2008/0258534 A1 Oct. 23, 2008

(30) Foreign Application Priority Data

Sep. 18, 2006 (EP) ..... 06120805

(51) Int. Cl.
*A47C 7/14* (2006.01)
*A47C 7/02* (2006.01)

(52) U.S. Cl. ..... 297/284.4; 297/452.14; 297/452.15; 297/DIG. 2

(58) Field of Classification Search ..... 297/284.4, 297/452.3, 452.31, 452.14, 452.15, DIG. 2
See application file for complete search history.

(56) References Cited

U.S. PATENT DOCUMENTS 3,093,413 A * 6/1963 Chancellor, Jr. ..... 297/284.4
3,521,929 A * 7/1970 Pearson ..... 297/452.14
4,032,190 A * 6/1977 Muller-Deisig et al. 297/DIG. 2 X
4,316,632 A * 2/1982 Brauning ..... 297/291
4,418,958 A * 12/1983 Watkin ..... 297/452.15
4,529,247 A * 7/1985 Stumpf et al. ..... 297/452.14 X
4,733,910 A * 3/1988 Brennan ..... 297/DIG. 2 X
4,856,846 A * 8/1989 Lohmeyer ..... 297/452.15 X
4,892,356 A * 1/1990 Pittman et al. ..... 297/452.15
5,102,196 A * 4/1992 Kaneda et al. ..... 297/452.15
5,577,811 A * 11/1996 Ogg ..... 297/452.15
5,649,739 A * 7/1997 Zapf ..... 297/284.4 X
5,711,575 A * 1/1998 Hand et al. ..... 297/284.6
5,997,094 A 12/1999 Cvek
6,378,942 B1 * 4/2002 Chu ..... 297/284.4
6,409,268 B1 * 6/2002 Cvek ..... 297/452.29 X
6,688,686 B1 2/2004 McEvoy et al.
6,688,687 B2 * 2/2004 Chu ..... 297/284.4
6,755,467 B1 * 6/2004 Chu ..... 297/284.4 X (Continued)

FOREIGN PATENT DOCUMENTS

JP 2003070588 3/2003

OTHER PUBLICATIONS

EP SearchReport, Application No. 06120805.4-1258, dated Mar. 15, 2007.

*Primary Examiner*—Rodney B White
(74) *Attorney, Agent, or Firm*—Patterson & Sheridan, L.L.P.

(57) ABSTRACT

Chair backrest, comprising a support structure constituted by a single piece of injected plastic material, including a bearing section having a front surface against which a user's back is to bear. The bearing section has an opening that extends in a lumbar region of the front surface. The backrest comprises a lumbar support panel movably positioned in said opening. The lumbar support panel has a front surface against which a lumbar region of the user's back is to bear and it has an outer perimeter that is connected to the edge of said opening by means of an elastic element that tends to thrust the support panel towards a position in which the front surface of the lumbar support panel projects anteriorly relative to the front surface of said bearing section.

3 Claims, 6 Drawing Sheets

U.S. PATENT DOCUMENTS

| | | | | |
|---|---|---|---|---|
| 7,063,384 | B2 * | 6/2006 | Liu | 297/284.4 |
| 7,303,232 | B1 * | 12/2007 | Chen | 297/284.8 |
| 7,334,841 | B2 * | 2/2008 | Chou | 297/284.4 |
| 7,422,284 | B2 * | 9/2008 | Hartenstine et al. | 297/452.15 X |
| 2002/0060485 | A1 * | 5/2002 | Fischer et al. | 297/284.4 |
| 2005/0006935 | A1 * | 1/2005 | Chang | 297/284.4 |
| 2005/0151400 | A1 | 7/2005 | Liu | |
| 2006/0097556 | A1 * | 5/2006 | Jang | 297/284.4 |
| 2008/0018154 | A1 * | 1/2008 | Chou | 297/284.4 |
| 2008/0296945 | A1 * | 12/2008 | Bedford et al. | 297/284.4 |

* cited by examiner

CHAIR BACKREST WITH INTEGRAL LUMBAR SUPPORT

CROSS-REFERENCE TO RELATED APPLICATIONS

This application claims benefit of European patent application serial number 06120805.4, filed Sep. 18, 2006, which is herein incorporated by reference.

BACKGROUND OF THE INVENTION

1. Field of the Invention

The present invention relates to a chair comprising a support structure constituted by a single piece of injected plastic material, including a bearing section having a front surface against which a user's back is to bear.

2. Description of the Related Art

To enhance comfort, chair backrests are often provided with lumbar supports able to sustain and to apply an elastic force against the user's lumbar region.

Known lumbar support devices are generally constituted by a high number of components and they have a bulk that makes their use incompatible in the simplest, most economical chairs in which the backrest comprises a single piece of injected plastic material.

SUMMARY OF THE INVENTION

The object of the present invention is to provide a chair backrest formed by a single piece of injected plastic material and provided with an integrated lumbar support that is simple, economical and able to provide a high level of comfort.

According to the present invention, said object is achieved by a backrest having the characteristics set out in claim 1.

BRIEF DESCRIPTION OF THE DRAWINGS

The present invention shall now be described in detail with reference to the accompanying drawings, provided purely by way of non limiting example, in which.

DETAILED DESCRIPTION

Figure 1:
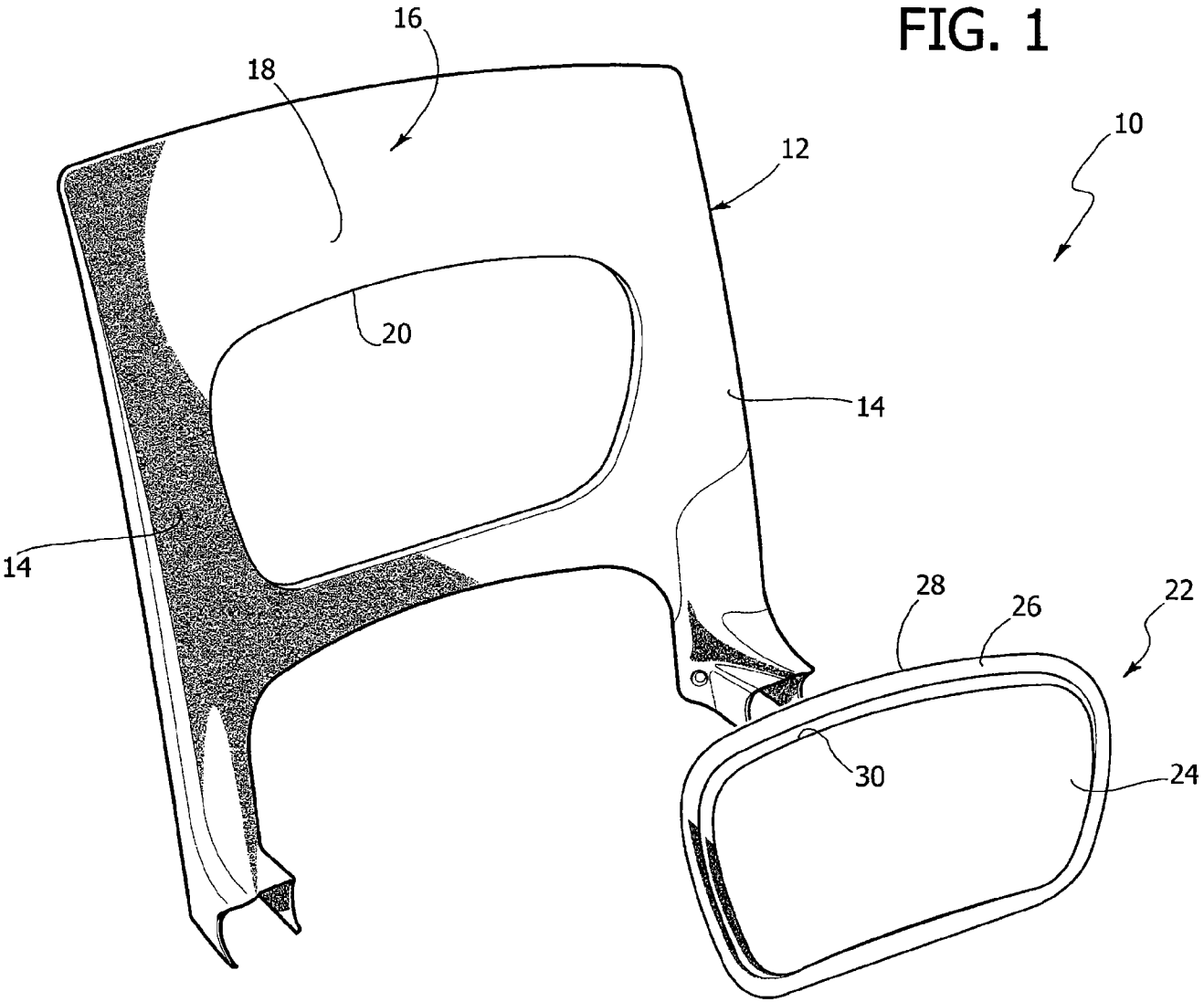
FIG. 1 is an exploded perspective view of a backrest according to the present invention.
Figure 2:
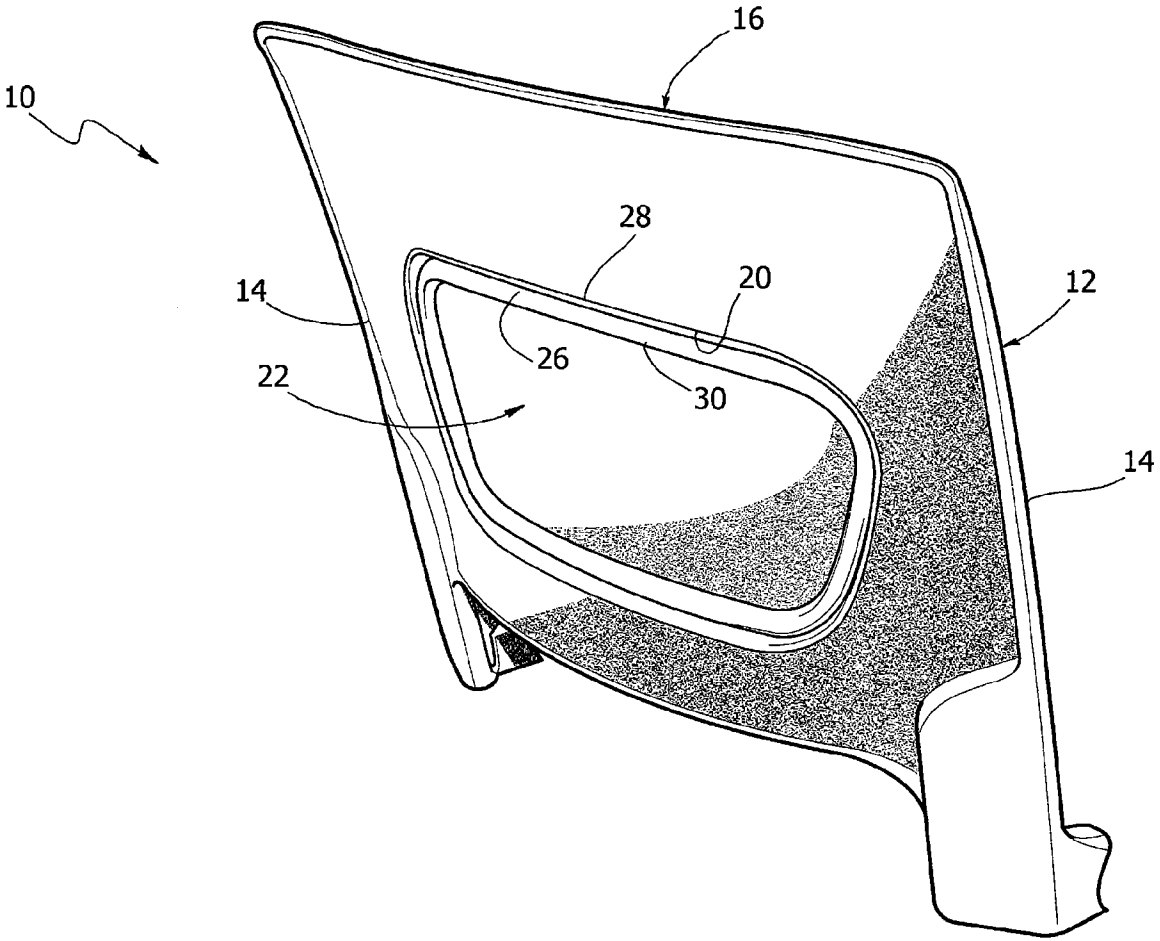
FIG. 2 is a rear perspective view of the backrest of FIG. 1.
Figure 3:
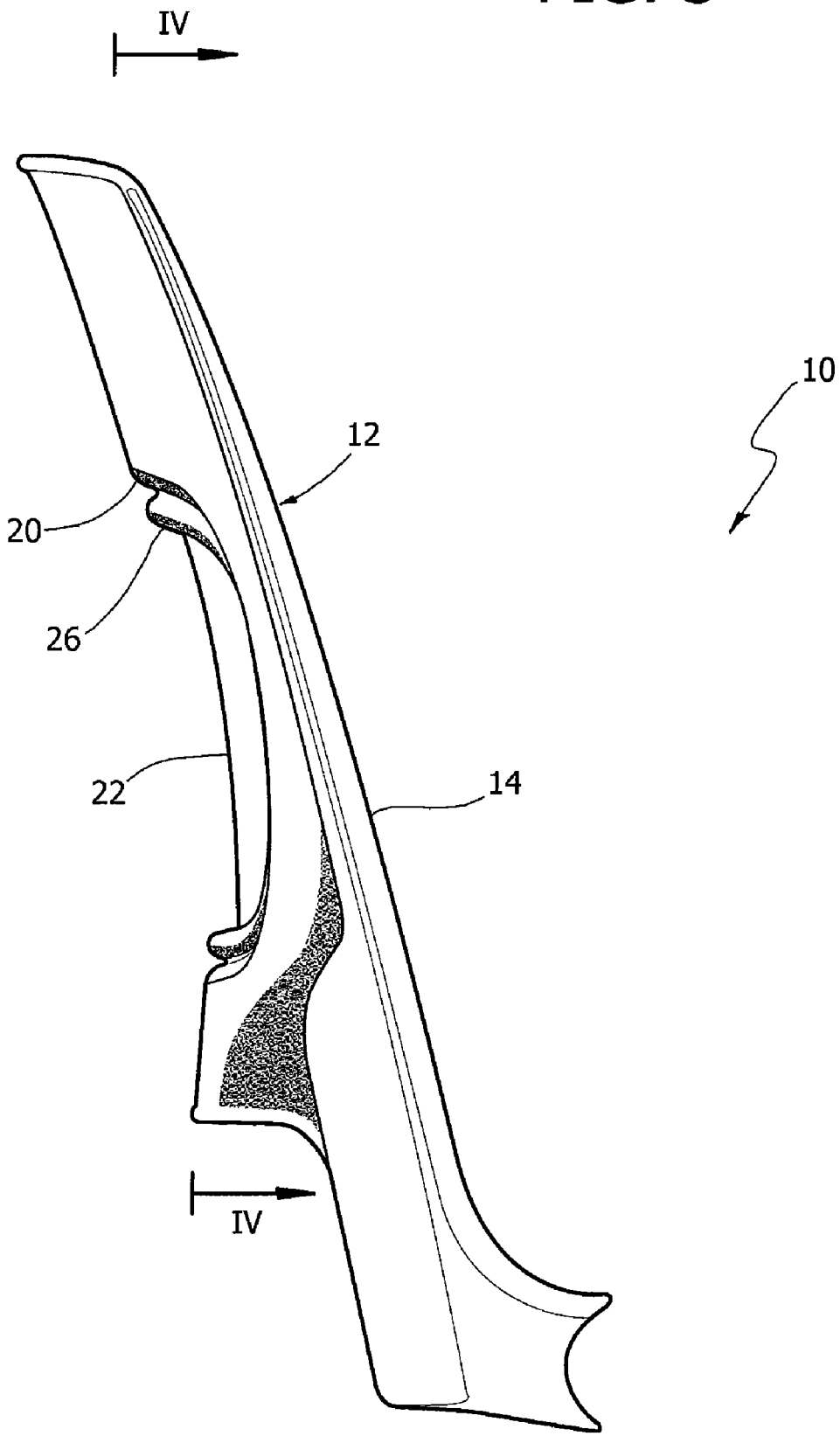
FIG. 3 is a lateral view of the backrest of FIG. 1, FIGS. 4*a-c* are sections according to the line IV-IV of FIG. 3, showing the lumbar support in different positions.

With reference to the figures, the numeral 10 designates a backrest according to the present invention. The backrest 10 comprises a support structure 12 constituted by a single piece of injected plastic material. The support structure 12 is constituted by relatively rigid plastic material, preferably polypropylene.

The support structure 12 comprises, in a single piece of injected material, two lateral uprights 14 and a bearing section 16 against which a user's back is to bear. The bearing section 16 extends between the two uprights 14 and it has a front surface 18 with an arched shape.

The bearing section 16 of the support structure 12 has a through opening 20 that extends in a lumbar region of the front surface 18, i.e. the region against which, in use, the lumbar region of a user's back bears. The shape and the dimension of the opening 20 approximate the contact area between the lumbar region of an average user and the front surface 18 of the bearing section 16.

The backrest 10 comprises a lumbar support panel 22 positioned movably in the opening 20. The lumbar support panel 22 has a shape matching that of the opening 20 but with smaller dimensions than those of the opening. Therefore, between the mutually facing edges of the panel 22 and of the opening 20 is defined a clearance, preferably with constant thickness, along the entire perimeter of the panel 22.

The lumbar support panel 22 has a front surface 24 against which the lumbar region of the user's back is to bear. The lumbar support panel 22 is made of relatively rigid injected plastic material. Preferably, the lumbar support panel 22 is made of the same material as the support structure 12. The front surface 24 of the frontal support panel 22 preferably has an arched shape with a curvature matching that of the front surface 18 of the bearing section 16.

The lumbar support panel 22 is connected to the support structure 12 by means of an elastic element 26 made of injected elastomeric material. The elastic element 26 preferably has an annular shape that completely surrounds the lumbar support panel 22. In its cross section, the elastic element 26 is preferably bellows shaped. The radially outer edge 28 of the elastic element 26 is fastened to the edge of the opening 20 and the radially inner edge of the elastic element 26 is fastened to the edge of the lumbar support panel 22.

Alternatively, the elastic element could be formed by a plurality of radial bridges with bellows cross section made of injected elastomeric material, distanced from each other in circumferential direction. For example, four radial bridges, arranged at 90° from each other, or three radial bridges, mutually distanced by 120°, can be provided.

In a preferred method for fabricating the backrest according to the present invention, the support structure 20 and the lumbar support panel 22 are constructed with a single injection moulding operation, leaving an empty clearance between the edge of the panel 22 and the edge of the opening 20. After the injection of the relatively rigid plastic material forming the support structure 12 and the lumbar support panel 22, in the same injection moulding equipment is carried out a co-injection of a flexible elastic material in the clearance defined between the edges of the lumbar support panel 22 and of the opening 20. The outer edges 28, 30 of the elastic elements 26 are fastened to the corresponding edges of the opening 20 and of the lumbar support panel 22 during the same co-injection operation whereby the elastic element 26 is formed.

Figure 4C:
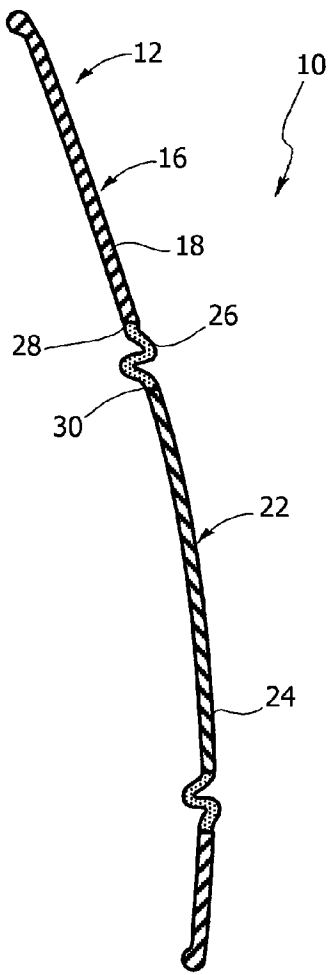
Figure 4B:
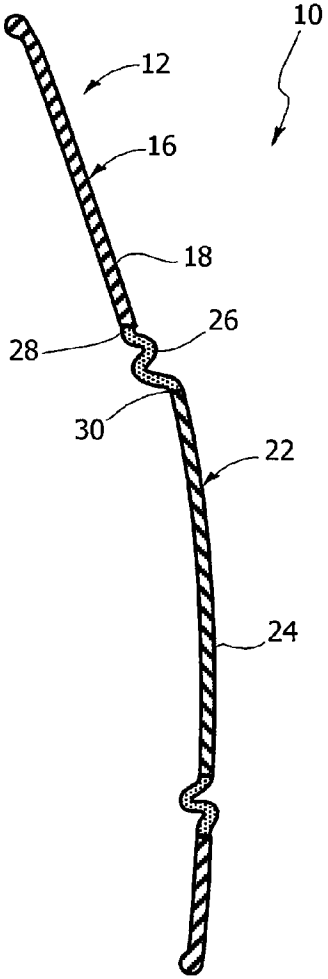
Figure 4A:
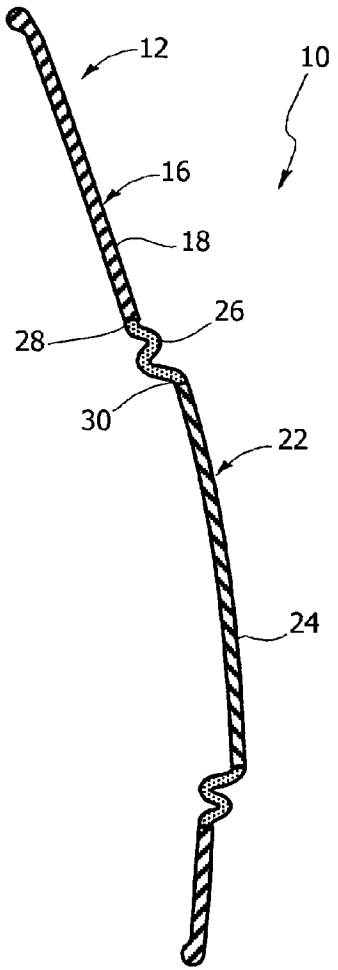
Figure 5:
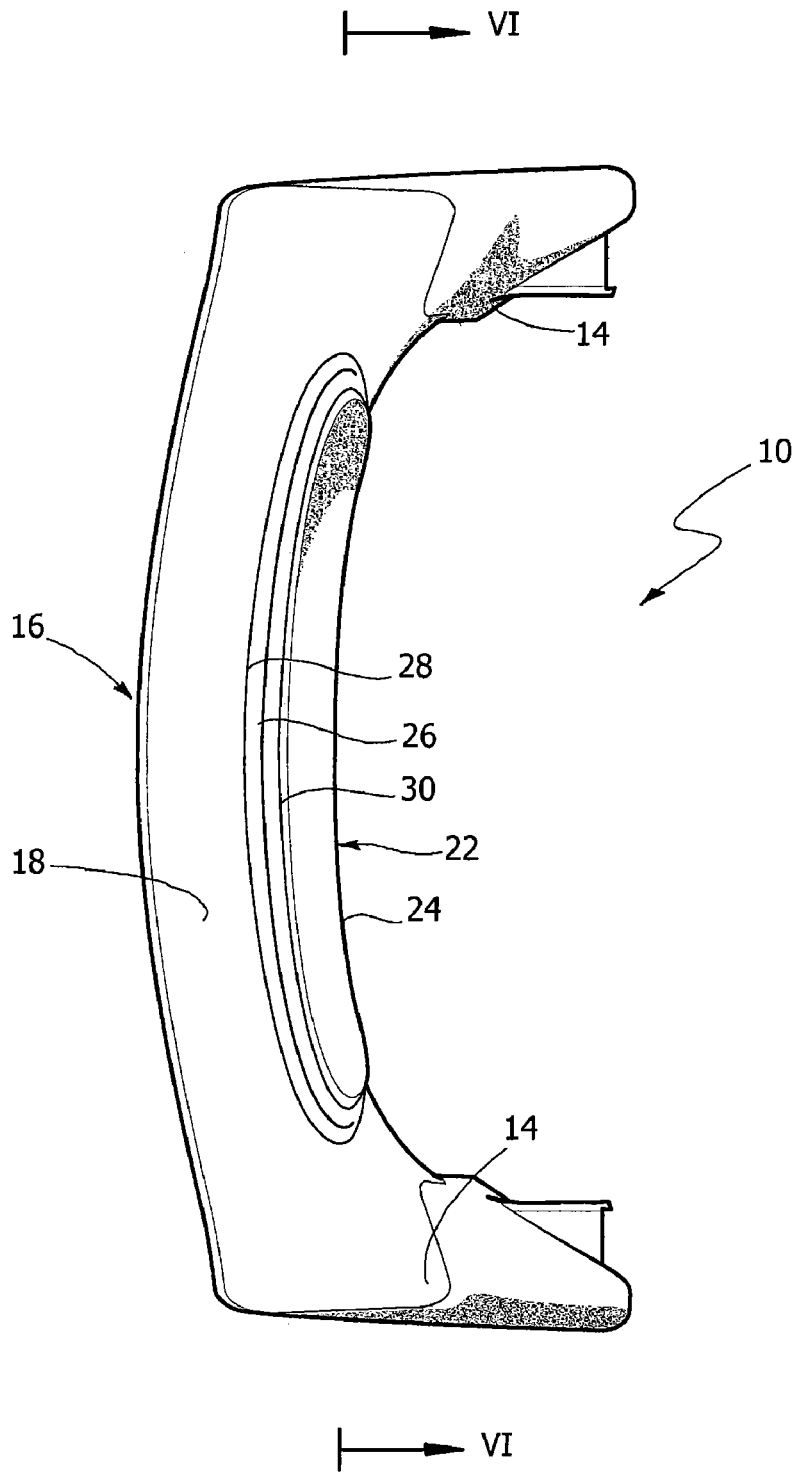
FIG. 5 is a plan view of the backrest of FIG. 1, and FIGS. 6*a-d* are sections according to the line VI-VI of FIG. 5, showing the lumbar support in different positions.
Figure 6D:
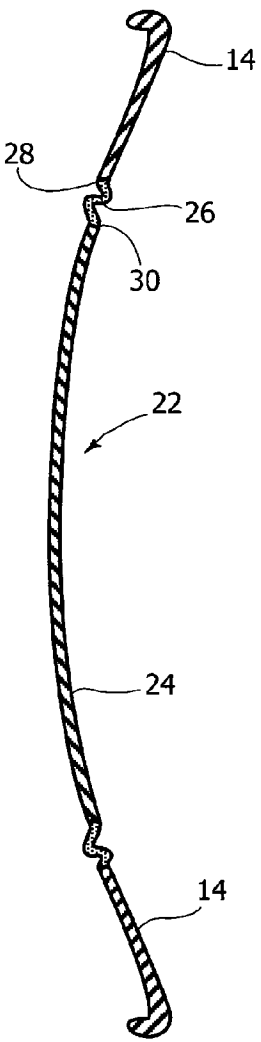
Figure 6C:
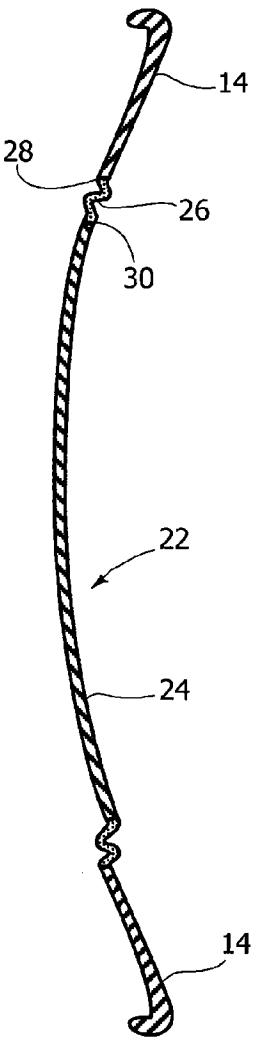
Figure 6B:
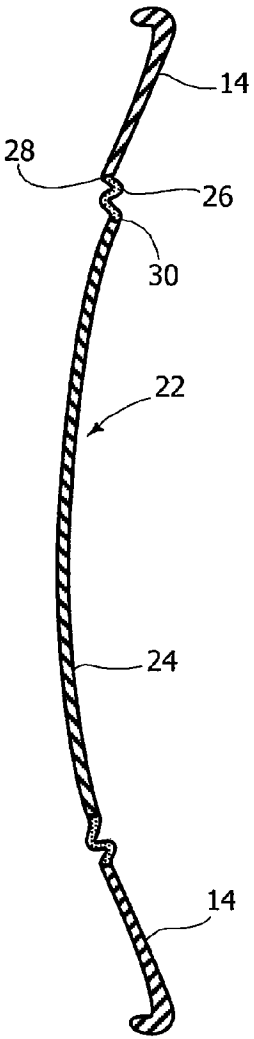
Figure 6A:
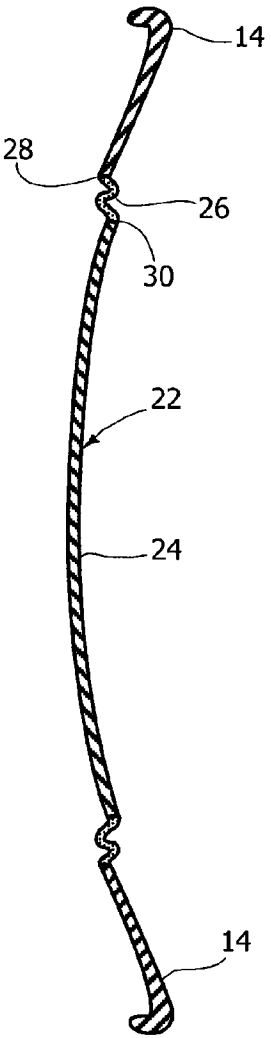

In the absence of a backward thrust applied on the lumbar support panel 22, the elastic element 26 keeps the lumbar support panel 22 in the position shown in FIGS. 6*a* and 4*a*. In this position, the front surface 24 of the lumbar support panel 22 projects anteriorly relative to the front surface 18 of the bearing section 16.

When a user bears with his/her back against the support section 16, the lumbar region of the user's back pushes the lumbar support panel 22 backwards. The elastic element 26 produces an elastic force which presses the panel 22 against the user's lumbar region. The lumbar support panel 22 can also move asymmetrically relative to the support structure 12, as shown for example in FIGS. 4*b*, 4*c* and 6*b*, 6*c*, 6*d*. The lumbar support panel 22 returns to the initial position when the backward thrust exerted by the user ceases.

The elastic element 26 allows an orientation in space of the lumbar support panel 22 for which said panel adapts perfectly to the user's morphology. The panel 22 provides an adequate support of the lumbar region and increases the sensation of comfort perceived by the user.

While the foregoing is directed to embodiments of the present invention, other and further embodiments of the invention may be devised without departing from the basic scope thereof, and the scope thereof is determined by the claims that follow.

The invention claimed is:

1. A chair backrest, comprising: a support structure constituted by a single piece of injected plastic material, including a bearing section having a front surface against which a user's back is to bear, the bearing section having an opening that extends in a lumbar region of said front surface, the backrest comprising a lumbar support panel movably positioned in said opening, the lumbar support panel having a front surface against which a lumbar region of the user's back is to bear and having an outer perimeter that is connected to the edge of said opening by means of an elastic element that tends to thrust the support panel towards a position in which the front surface of the lumbar support panel projects anteriorly relative to the front surface of said bearing section, wherein the support structure and the lumbar support panel are made of a first relatively rigid plastic material and wherein the elastic element is made of a second relatively flexible injected elastic material.

2. A chair backrest, comprising: a support structure constituted by a single piece of injected plastic material, including a bearing section having a front surface against which a user's back is to bear, the bearing section having an opening that extends in a lumbar region of said front surface, the backrest comprising a lumbar support panel movably positioned in said opening, the lumbar support panel having a front surface against which a lumbar region of the user's back is to bear and having an outer perimeter that is connected to the edge of said opening by means of an elastic element that tends to thrust the support panel towards a position in which the front surface of the lumbar support panel projects anteriorly relative to the front surface of said bearing section, wherein the elastic element completely surrounds the frontal support panel.

3. A chair backrest, comprising: a support structure constituted by a single piece of injected plastic material, including a bearing section having a front surface against which a user's back is to bear, the bearing section having an opening that extends in a lumbar region of said front surface, the backrest comprising a lumbar support panel movably positioned in said opening, the lumbar support panel having a front surface against which a lumbar region of the user's back is to bear and having an outer perimeter that is connected to the edge of said opening by means of an elastic element that tends to thrust the support panel towards a position in which the front surface of the lumbar support panel projects anteriorly relative to the front surface of said bearing section, wherein elastic element comprises a plurality of radial bridges, angularly distanced from each other.

* * * * *